US005080848A

United States Patent [19]

Strauss et al.

[11] Patent Number: 5,080,848

[45] Date of Patent: * Jan. 14, 1992

[54] PROCESS FOR MAKING CONCENTRATED SURFACTANT GRANULES

[75] Inventors: Daniel L. Strauss, Mason; Charles L. Stearns, Cincinnati, both of Ohio

[73] Assignee: The Proctor & Gamble Company, Cincinnati, Ohio

[ * ] Notice: The portion of the term of this patent subsequent to May 15, 2007 has been disclaimed.

[21] Appl. No.: 288,759

[22] Filed: Dec. 22, 1988

[51] Int. Cl.[5] ..... C11D 11/00

[52] U.S. Cl. ..... 264/117; 264/140; 252/89.1; 252/134; 252/174; 252/539; 252/540; 252/558; 252/559

[58] Field of Search ..... 264/115, 117, 118, 140; 252/89.1, 134, 174, 539, 540, 558, 559

[56] References Cited

U.S. PATENT DOCUMENTS

| | | | |
|---|---|---|---|
| 2,220,099 | 11/1940 | Guenther et al. | 562/93 |
| 2,477,383 | 7/1949 | Lewis | 252/534 |
| 3,664,961 | 5/1972 | Norris | 252/99 |
| 3,919,678 | 11/1975 | Penfold | 335/296 |
| 4,162,994 | 7/1979 | Kowalchuk | 252/532 |
| 4,222,905 | 9/1980 | Cockrell, Jr. | 252/547 |
| 4,239,659 | 12/1980 | Murphy | 252/524 |
| 4,427,417 | 1/1984 | Porasik | 23/313 R |
| 4,487,710 | 12/1984 | Kaminski | 252/546 |
| 4,515,707 | 5/1985 | Brooks | 252/368 |
| 4,925,585 | 5/1990 | Strauss et al. | 264/117 |

*Primary Examiner*—David A. Simmons
*Assistant Examiner*—J. Sells
*Attorney, Agent, or Firm*—Leonard Williamson; Robert B. Aylor; Richard C. Witte

[57] ABSTRACT

The present invention relates to an energy saving process for preparing concentrated or condensed surfactant granules. High active surfactant paste is chilled and granulated using fine dispersion mixing. The product surprisingly provides discrete, uniform (200–2,000 micron) granular particles. The granules of the present invention are preferably pure surfactant to be used as an intermediate in a final detergent formulation.

10 Claims, No Drawings

PROCESS FOR MAKING CONCENTRATED SURFACTANT GRANULES

FIELD OF INVENTION

The present invention relates to a process for preparing concentrated (condensed) surfactant granules.

BACKGROUND OF THE INVENTION

Granular surfactant compositions are principally prepared by spray or drum drying In the spray drying process the surfactant components, plus perhaps salts and builders, are mixed with as much as 35–50% water to form a slurry. The slurry obtained is heated and spray dried, which is expensive.

Such spray drying requires 30–40 wt.% of the water to be removed. The spray drying equipment used is expensive. The granule obtained has good solubility but a low bulk density, so the packing volume is large. The particles also may be sticky, particularly when hot, and thus wall buildup is an additional problem. There are other known disadvantages in preparing granular materials by spray drying, such as environmental concerns and heat sensitivity. An agglomeration process, on the other hand, would be cleaner, as well as less expensive, both in terms of equipment and operating costs.

There are many prior art nonspray-drying processes which produce surfactant granules. Most, however, require mixing of the surfactant with other materials such as inorganic salts or aluminosilicate-type materials. Some other processes require use of an acid form of the surfactant to work. In most cases, a diluted surfactant particle is obtained. The major problem with the use of a high active surfactant paste as a starting material in a one step granulation process is its stickiness.

In U.S. Pat. No. 4,515,707, Brooks, issued May 7, 1985; Japanese laid-open Appln. No. 183540/1983, Kao Soap Co., Ltd., filed Sept. 30, 1983; and Japanese Sho. 61-118500, Lion K.K., June 5, 1986, high shear and/or cold mixing processes are disclosed. Typically, excess carbonate is required (2–10 molar excess) to assure reasonable conversion of the surfactant acids. Excess carbonate adversely drives up the wash water pH to the very alkaline range which can be undesirable, particularly for some nil-phosphate formulas and formulas containing peracid bleaches Such high shear and cold mixing processes are known, but they have drawbacks, e.g., some require an extra grinding step or some other action, as well as the addition of other ingredients, primarily solids. Others use a dry neutralization technique for mixing the acid form of the surfactant with sodium carbonate.

A practical problem with the use of a surfactant acid form is that it requires immediate use after it is made, or cool temperature storage, for such highly reactive acids, such as the alkyl sulfate acids, are subject to degradation unless cooled They also tend to undergo hydrolysis during storage, forming free sulfuric acid and alcohol In practical terms, such prior art processes require close-coupling of surfactant acid production with granulation which requires an additional capital investment In U.S. Pat. No. 4,162,994, Kowalchuk, issued July 31, 1979, it is disclosed that calcium salts are required to overcome problems in processing by nonspray drying (i.e., mechanical) means formulations based on sodium salts of anionic surfactants and certain nonionic surfactants. A drawback to that process is that insoluble calcium salts can lower the solubility of the formulation, which is of particular importance in stress situations, such as in pouch-type executions.

U.S. Pat. No. 4,427,417, Porasik, issued Jan. 24, 1984, v discloses preparing granular detergent compositions from hydratable particulate detergent salts, etc., under conditions insuring complete hydration and agglomerating them into storage stable, dry, pourable agglomerates. This patent is incorporated herein by reference.

SUMMARY OF THE INVENTION

The present invention relates to an economical process for making a dense, concentrated surfactant granule from a high active surfactant paste using fine dispersion cold granulation.

OBJECTS OF THE INVENTION

An important object of the present invention is to make a denser and more concentrated surfactant granular product by an agglomeration process without an expensive drying step. Another object is to provide a more concentrated surfactant granule which can be stored and then admixed with other ingredients to provide a final end product. Another object of the process of this invention is to provide a formulated granule containing higher total surfactant levels than typically obtained via other means Yet another object of the present invention is to prepare a very high active surfactant granule essential free of hydrated inorganic salts. Other objects of the present invention will be apparent in view of the following.

DETAILED DESCRIPTION OF THE INVENTION

The process of the present invention comprises fine dispersion mixing and cooling of a high active surfactant paste to provide a very concentrated surfactant granule. Most high active surfactant pastes are too tacky at normal mixing temperatures to successfully granulate using fine dispersion mixing. So the high active surfactant paste is cooled as needed to a granulation temperature while mixing. Large discrete particles (granules) are surprisingly formed right in the mixer. Thus "cold" granulation of a high surfactant past is achieved.

The granulation temperature, according to the present invention, ranges from about −65° C. to 25° C. using a critical fine dispersion mixing tip speed of from about 5 m/sec. to about 50 m/sec. Dry ice is a preferred cooling means.

A benefit of the present invention is that the preferred granules made according to the present invention are large, essentially pure surfactant granules. They preferably have a bulk density of from about 0.4 to about 1.1 g/cc, more preferably from about 0.5 to about 0.8 g/cc. The weight average particle size of the preferred particles of this invention are from about 200 to about 2,000 microns. The more preferred granules have a particle size range of from 300 to 1,200 microns. Yields of 25% to 85% in these ranges can be achieved. A second brief mixing increases yields of granular particles in these preferred ranges. Oversized and undersized particles can also be recycled.

The more preferred granulation temperatures of the high active surfactant paste ranges from about −40° C. to about 10° C., and most preferably from about −30°

C. to about 0° C. More details of the present invention are highlighted below.

The resultant surfactant granules made by the process of the present invention can comprise a combination of all, or substantially all, of the ingredients of the total composition or they can be used as an intermediate. Thus, such granules greatly reduce or even eliminate the need to admix additional materials for a final detergent formulation. Also, the possibility of segregation of ingredients during shipping, handling or storage is greatly reduced, especially if only minor quantities of other materials of differing particle sizes or densities are to be included.

Separately, the concentrated granule of this invention can be admixed with detergent granules produced by more conventional means to increase the total surfactant level in a final formulation.

Methods of Cooling the High Active Surfactant Paste

Any suitable method of cooling the high active surfactant paste to a granulation temperature can be used. Cooling jackets or coils can be integrated around or into the mixer. Chipped dry ice or liquid $CO_2$ can be added or injected into the uniform paste. The idea is to lower the high active surfactant paste temperature to a granulation temperature so that it can be finely dispersed or "granulated" into discrete particles.

Paste Viscosity and Processing

Two important parameters of the high active surfactant pastes which can affect the parameters of the mixing and granulation step of the present invention are the paste temperature and the paste viscosity. The viscosity is a function of surfactant concentration and its temperature. The high active surfactants of the present invention have viscosities which range from about 10,000 cps to 10,000,000 cps; preferably, from about 70,000 to about 7,000,000 cps; and more preferably from about 100,000 to about 1,000,000 cps. These viscosities are measured at a temperature of about 50° C. for the present invention.

The high active surfactant paste can be introduced into the mixer at an initial temperature in the range of about 5–70° C., preferably about 20–30° C. Higher temperatures reduce their viscosities but a temperature greater than about 70° C. can lead to poor initial mixing due to increased product stickiness.

The process of the present invention surprisingly forms large, but usable, granules, preferably in the 200 to 1200 micron range. Such large granules are preferred, particularly if the surfactant granule is to be admixed with other materials which have a tendency to be dusty. Particles of similar size are preferred to minimize segregation. No extra grinding step is required or desirable. In general, larger particles are less dusty, which is important in many consumer applications, especially those which comprise porous, unitized dose pouch-like products. Such porous products are designed: (1) to avoid consumer contact with the product and (2) to reinforce the convenience and nonmessiness perceptions of a unitized pouch form. If desired, granules of insufficient size can be screened after drying and recycled to the fine dispersion mixer.

The Fine Dispersion Mixing and Granulation

Unless otherwise specified, the terms "fine dispersion mixing" and/or "granulation," as used herein are synonymous and mean mixing and granulating of a high active surfactant paste in a fine dispersion mixer using a blade tip speed of from about 5 m/sec. to about 50 m/sec. The total residence time of the mixing and granulation process is preferably in the order of from 0.1 to 10 minutes, more preferably 0.5–8 and most preferably 1–6 minutes. The more preferred mixing and granulation tip speeds are about 10–40 m/sec. and about 15–35 m/sec.

The Littleford Mixer, Model #FM-130-0-12, with internal chopping blades and the Cuisinart ®Food Processor, Model #DCXPlus, with 7.75 inch (19.7 cm) blades are two examples of suitable mixers. Any other mixer with fine dispersion mixing and granulation capability and which preferably has a residence time in the order of 0.1 to 10 minutes can be used. The "turbine-type" impeller mixer, having several blades on an axis of rotation, is preferred. The invention can be practiced as a batch or a continuous process.

The mixer must finely disperse the paste and, if desired, the other ingredients. When the contents of the mixer are cooled, the mixing must be conducted at said fine dispersion tip speed in order to granulate the surfactant into discrete particles. Care must be taken not to use too low or too high of a tip speed at the granulation step. While not being bound to a theory, "too high a shear" is believed to prevent granulation because of a wide variety of stresses, e.g., a broader particle size distribution caused by the higher tip speeds with a higher level of fines generated. Also, too high of a tip speed increases the temperature of the material and additional cooling is required.

Care must be taken not to overload any fine dispersion mixer with two much or too little surfactant paste material. If there is more than one material the results are poor mixing and unsatisfactory granulation. Thus, care must be taken to load the mixer with a proper level of paste material so that satisfactory mixing and granulation are achieved. Similar to too low of a tip speed, overloading the mixer results in poor dispersion, reduced uniformity and large lumps. On the other hand, too high of a tip speed increases the production of undesirable fines.

Work Input

The work input required for fine dispersion mixing in the practice of the present invention varies with: (1) the type of fine dispersion mixer used, (2) the mixer loading level, (3) the viscosity of the paste material, and (4) the amount and the type of dry solids used, if any. E.g., the Total Work required for mixing and granulation of several preferred paste materials using a laboratory Cuisinart food processor, Model #DCX-Plus varied from about 7 BTU's to about 16 BTU's per pound of paste material. The corresponding incremental Work varied from about 0.4 BTU's to about 2.6 BTU's per pound of paste material. The No Load Work for the Cuisinart food processor is about 0.2 BTU's per second. The Cuisinart food processor has a single 19.7 cm flat horizontal propeller and is operated at 1800 rpm, which is a tip speed of about 18.55 m/sec.

The Total Work required to mix and granulate the surfactant paste of the present invention can vary from about 3 BTU's to about 30 BTU's per pound of material depending on viscosity, load, etc. A preferred range is from about 5 BTU's to about 20 BTU's per pound. These BTU ranges in kilogram of material are, respectively, from about 6.6 to 66, and from about 11 to 44 BTU/Kg.

Some benefits of fine dispersion mixing and granulation include (1) a lower level of granulated fines; (2) a more uniform granular particle size distribution; and (3) a higher density granule than a granular product made with standard agglomerationtype mixers, such as pan-type mixers.

High Active Surfactant Paste

The activity of the aqueous surfactant paste is at least 50% and can go up to about 98%; preferred activities are: 60–80% and 65–75%. The balance of the paste is primarily water but can include a processing aid such as mineral oil. The resultant concentrated surfactant granules can be added to dry detergency builders or conventionally agglomerated with binders with these builders or other materials to yield desired finished formula compositions.

In the process of the present invention, it is preferable to use higher active surfactant pastes to minimize the total water level in the system during mixing and granulating. The benefits of lower water levels are to allow for (1) higher levels of other liquids in the formula without causing stickiness; (2) less cooling, due to higher granulation temperatures; and (3) less granular drying to meet final moisture limits.

It is important that the moisture or solvent (hereinafter referred to as "moisture") content of the high active surfactant should not exceed 50%. The total moisture can range from about 2% to about 50%, but is preferably from about 10% to about 40%, and more preferably from about 15% to about 30%. The lower granulation temperatures are used for the higher moisture-containing pastes. Conversely, the higher granulation temperatures can be used for lower moisture pastes.

Paste compositions which have lower moisture contents of below 5%, e.g., about 1% to 4%, can contain an effective amount of an organic liquid solvent or processing aid. Examples of such aids are selected from suitable organic liquid, including mineral oil, glycerin, short chain alcohols, and the like, and mixtures thereof. The processing aid preferably can be used at a level of "0.5% to 20%," more preferably about 1–10%; most preferably about 2–5% by weight of the paste.

The desired moisture content of the surfactant granules of this invention can be adjusted by adding other desired dry ingredients prior to cooling and granulation. Thus, additional "drying" is unnecessary in low moisture formulations. When desirable, drying the discrete granules can be accomplished in a standard fluid bed dryer. The idea here is to provide a free flowing granule with a desired moisture content of 0.5–10%, preferably 1–5%.

The aqueous surfactant paste contains an organic surfactant selected from the group consisting of anionic, zwitterionic, ampholytic, nonionic and cationic surfactants, and mixtures thereof. Anionic surfactants are preferred. Surfactants useful herein are listed in U.S. Pat. No. 3,664,961, Norris, issued May 23, 1972, and in U.S. Pat. No. 3,919,678, Laughlin et al., issued Dec. 30, 1975, both incorporated herein by reference. Useful cationic surfactants also include those described in U.S. Pat. No. 4,222,905, Cockrell, issued Sept. 16, 1980, and in U.S. Pat. No. 4,239,659, Murphy, issued Dec. 16, 1980, both incorporated herein by reference. The following are representative examples of surfactants useful in the present compositions.

Water-soluble salts of the higher fatty acids, i.e., "soaps," are useful anionic surfactants in the compositions herein. This includes alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{8-C18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and betaalkyloxy alkane sulfonates containing from about 1 to 3 carbon atoms in the alkyl group and from about 8 to about 20 carbon atoms in the alkane moiety.

The preferred anionic surfactant pastes are mixtures of linear or branched alkylbenzene sulfonates having an alkyl of 10–16 carbon atoms and alkyl sulfates having an alkyl of 10–18 carbon atoms. These pastes are usually produced by reacting a liquid organic material with sulfur trioxide to produce a sulfonic or sulfuric acid and then neutralizing the acid to produce a salt of that acid. The salt is the surfactant paste discussed throughout this document. The sodium salt is preferred due to end performance benefits and cost of NaOH vs. other neutralizing agents, but is not required as other agents such as KOH may be used. The neutralization can be performed as part of the fine dispersion mixing step, but preneutralization of the acid in conjunction with the acid production is preferred.

Water-soluble nonionic surfactants are also useful as surfactant in the compositions of the invention. Many final detergent compositions include nonionics or nonionic/anionic surfactant blends. Inclusion of nonionics in many applications is difficult, particularly if a spray-dry process is used, because of potential degradation and environmental concerns. A nonionic granule can thus be admixed with a spray-dry granule to produce a preferred final formulation. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 4 to 25 moles of ethylene oxide per mole of alcohol. Particularly preferred are the condensation products of alcohols having an alkyl group containing from about 9 to 15 carbon atoms with from about 4 to 25 moles of ethylene oxide per mole of alcohol; and condensation products of propylene glycol with ethylene oxide.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

The high active surfactant paste formulation must be solid at about room temperature unless the granules are kept cool until mixed with other detergent solids.

The terms "LAS" and "AS" as used herein mean, respectively, "sodium lauryl benzene sulfonate" and "alkyl sulfate." The terms like "$C_{45}$" mean $C_{14}$ and $C_{15}$ alkyl, unless otherwise specified. Some of these AS and LAS surfactants do not require cooling if used at about 20–25° C.

All examples used a Cuisinart food processor, Model #DCX-Plus with 19.7 cm metal blades operating at 1800 rpm. The tip speed is 18.55 m/sec.

Detergency Builders

The surfactant granules of the present invention can be made with some detergency builder and/or inorganic, water-soluble salts. So, the surfactant paste can contain such materials at a ratio of salt/builder to surfactant active of from about 0:1 to about 1:1 on a dry weight basis. Any compatible detergency builder or combination of builders or water-soluble salts can be used in the process to produce desired end products or intermediates. However, in most cases the inclusion of such solid material is unnecessary and not desired. The present invention is aimed at making a purer, denser surfactant granule.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Examples of neutral water-soluble salts include the alkali metal, ammonium or substituted ammonium chorides, fluorides and sulfates. The alkali metal, and especially sodium, salts of the above are preferred. Sodium sulfate is typically used in detergent granules and is a particularly preferred salt.

Other useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhydroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4. The compositions made by the process of the present invention does not require excess carbonate for processing, and preferably does not contain over 2% finely divided calcium carbonate as disclosed in U.S. Pat. No. 4,196,093, Clarke et al., issued Apr. 1, 1980, incorporated herein by reference, and is preferably free of the latter.

It is preferred not to hydrate any hydratable builder salts in the fine dispersion mixer in the process of the present invention.

Other Optionals

Other ingredients commonly used in detergent compositions can be included in the compositions of the present invention to produce desired end product laundry products, but are not necessary, and are included here to show the breadth of this invention. These include flow aids, color speckles, bleaching agents and bleach activators, suds boosters or suds suppressors, antitarnish and anticorrosion agents, soil suspending agents, soil release agents, dyes, fillers, optical brighteners, germicides, pH adjusting agents, nonbuilder alkalinity sources, hydrotropes, enzymes, enzyme-stabilizing agents, chelating agents and perfumes.

EXAMPLES

The invention will be better understood in view of the following nonlimiting examples. The percentages are on a weight basis, in the mixes prior to any subsequent follow-up drying, unless otherwise specified. The tables are followed with additional processing disclosure in the numbered examples.

The terms "LAS" and "AS" as used herein mean, respectively, "sodium lauryl benzene sulfonate" and "alkyl sulfate." The terms like "$C_{45}$" mean $C_{14}$ and $C_{15}$ alkyl, unless otherwise specified. Some of these AS and LAS surfactants do not require cooling if used at about 20–25° C.

A Cuisinart food processor, Model #DCX-Plus with 19.7 cm metal blades operating at 1800 rpm is used for all examples. The tip speed is 18.55 m/sec.

The viscosities of LAS and AS are measured using Brookfield HAT Serial No. 74002 as follows:

For 60% and 70%, at 0.5 rpm with spindle T-A at 50° C.;

For 74% AS, at 0.5 rpm with spindle T-E at 50° C.;

For 50% AS, at 2.5 rpm with spindle T-A at 50° C.

The granulation temperature for each high active surfactant paste is determined on a case by case basis.

EXAMPLE 1

An aqueous anionic $C_{13}$LAS surfactant paste having a detergent activity of 70% with the balance being water, plus a small amount of unreacted and sodium sulfate salt as a reaction by-product, is mixed with dry ice in a Cuisinart food processor. The viscosity of the paste is about 800,000 cps (see note below on viscosity measurement technique). The paste temperature was first about 25° C. The paste temperature drops from 25° C. to −50° C. and surfactant granules are formed.

The following tables summarize several examples of the invention.

TABLE OF EXAMPLES (Part 1)

| Example No. | Surfactant (% Activity) | % Surf. Active | % Unreacted | % Water | % Dry Builder |
|---|---|---|---|---|---|
| 1 | $C_{13}$LAS (70) | 70 | 3 | 27 | — |
| 2 | $C_{13}$LAS (60) | 60 | 3 | 37 | — |
| 3 | $C_{13}$LAS (70) | 63 | 3 | 34 | 10[a] |
| 4 | $C_{13}$LAS (93) | 60 | 3 | 2 | 35[b] |
| 5 | $C_{13}$LAS/$C_{45}$AS 1:1 (70) | 70 | 4 | 26 | — |
| 6 | $C_{45}$AS (74) | 74 | 5 | 21 | — |
| 7 | $C_{45}$AS (50) | 50 | 3 | 47 | — |
| 8 | $C_{45}$AS[e] (74) | 68.3 | 4 | 20 | — |
| 9 | Barlox 12[c] (87) | 87 | 3 | 10 | — |
| 10 | Barlox 12[c] (87) | 55 | 2 | 6 | 37[b] |
| 11 | Amphoterge K[d] (70) | 70 | 3 | 27 | — |

(Part 2)

| Example No. | Surfactant | Granulation Temperature °C. |
|---|---|---|
| 1 | $C_{13}$LAS | −50 |
| 2 | $C_{13}$LAS | −20 |
| 3 | $C_{13}$LAS | −35 |
| 4 | $C_{13}$LAS | 4 |
| 5 | $C_{13}$LAS/$C_{45}$AS 1:1 | −5 |
| 6 | $C_{45}$AS | 23 |
| 7 | $C_{45}$AS | −5 |
| 8 | $C_{45}$AS[e] | −2 |
| 9 | Barlox 12[c] | −60 |
| 10 | Barlox 12[c] | −40 |
| 11 | Amphoterge K[d] | −52 |

[a]Sodium sulfate

[b]Sodium carbonate monohydrate used in Examples 4 and 10 at 35% and 37%.

[c]Lauryl (12, 14, 16 blend) dimethyl amine oxide. Barlox 12 is the trade name of Lonza, Inc.

[d]Coconut based imidazoline amphoteric, monocarboxylic. Amphoterge K is the trade name of Lonza, Inc.

[e]Ex. 8 is made with 7.7% mineral oil as a processing aid.

EXAMPLE 2

Example 2 is similar to Example 1, except that a 60% active (vs. 70%) $C_{13}$LAS is used. The paste viscosity is about 350,000 cps. The temperature at granulation is about −20° C.

EXAMPLE 3

Example 3 is similar to Example 1, except that 10% sodium sulfate is added to the 70% active $C_{13}$LAS. The builder salt to surfactant active ratio is 0.16. The temperature at granulation is about −35° C.

EXAMPLE 4

Example 4 is similar to Example 3, except 93% active $C_{13}$LAS is used and 35% sodium carbonate monohydrate is added to the surfactant paste. The paste viscosity is >1,000,000 cps. The builder salt to surfactant active ratio is 0.54. The temperature at granulation is about 4° C.

EXAMPLE 5

Example 5 is similar to Example 1, except a 1:1 blend of $C_{13}$LAS and $C_{45}$AS is used. Both pastes have an activity level of 70%. The viscosity of the $C_{45}$LAS is >7,000,000 cps. The temperature at granulation is about −5° C.

EXAMPLE 6

Best Mode: Example 6 is similar to Example 1, except 74% active $C_{45}$AS (vs. 70% active $C_{13}$LAS) is used. The viscosity of the paste is >7,000,000 cps. The temperature at granulation is about 23° C.

The yield of these granules in the 200–2,000 micron particle size range is about 42%. The granules are set under ambient conditions and placed back in the mixer and mixed for about 15 seconds. The final yield is about 85%; moisture is about 14%.

EXAMPLE 7

Example 7 is similar to Example 6, except 50% active (vs. 74%) $C_{45}AS$ is used. The viscosity of the paste is 25,000 cps. The temperature at granulation is about −5° C.

EXAMPLE 8

Example 8 is similar to Example 6, except 7.7% mineral oil is added as a processing aid. The temperature at granulation is about −2° C.

EXAMPLE 9

Example 9 is similar to Example 1, except 87% active Barlox 12 ($C_{12-16}$ dimethyl amine oxide) is used instead of 70% $C_{13}LAS$. The viscosity of the paste is about 1,000,000 cps. The temperature at granulation is about −60° C.

EXAMPLE 10

Example 10 is similar to Example 9, except 37% sodium carbonate monohydrate is added to the 87% active Barlox 12. The builder salt to surfactant active ratio is 0.65. The temperature at granulation is about −40° C.

EXAMPLE 11

Example 11 is similar to Example 1, except 70% Amphoterge K is used instead of 70% $C_{13}LAS$. The viscosity of the paste is about 500,000 cps. The temperature at granulation is about −52° C.

In the above examples dense, concentrated, highly active surfactant granules are successfully made using the process of the present invention.

What is claimed is:

1. A process for making condensed surfactant granules comprising:

A. mixing surfactant paste having a detergency activity of at least 50%;

B. cooling said paste as needed to a granulation temperature of from about −65° C. to about 25° C.;

C. granulating said cooled paste into discrete detergent granules using fine dispersion mixing at a tip speed of about 5–50 m/sec; and wherein said surfactant is selected from the group consisting of anionic, zwitterionic, ampholytic, nonionic and cationic surfactants and mixtures thereof; and wherein said mixing and granulating are conducted with a mixer residence time of from about 0.1 to about 10 minutes.

2. A process according to claim 1 wherein said surfactant paste has a detergency activity up to about 98%; and wherein said paste has a viscosity of from 10,000 to about 10,000,000 cps at about 50° C.; and wherein said surfactant paste of Step A has a temperature of from about 5° C. to about 70° C.

3. A process according to claim 2 wherein said condensed surfactant granules have a surfactant detergency activity of at least 50%.

4. A process according to claim 1 wherein said granulation temperature of said paste is about −40° C. to about 10° C.

5. A process according to claim 1 wherein said tip speed is 10–40 m/sec and said residence time is 0.5–8 minutes.

6. A process according to claim 1 wherein said paste has a detergency activity of 60–80%; and wherein said paste has a viscosity of from about 70,000 to about 7,000,000 cps; said paste is used at an initial temperature of 20–30° C., and wherein said granulation temperature is about −30° C. to about 0° C. and wherein said discrete surfactant granules formed from said paste have an average particle size of from about 200 microns to about 2,000 microns and wherein said dried granules have a bulk density of from about 0.4 to about 1.1 g/cc.

7. The process according to claim 1 wherein the said detergency activity of said paste is about 65–75 ; and wherein the density of said granules is from about 0.5 to about 0.7 g/cc.

8. The process according to claim 1 wherein said surfactant paste contains a material selected from inorganic salts or builders and mixtures thereof having a ratio of salt/builder to paste active of from about 0:1 to about 1:1.

9. A process according to claim 1 wherein the moisture in said discrete granules is reduced by drying in a fluid bed dryer to a moisture content of 1–8%.

10. A product made by the process of claim 1.

* * * * *